US011085635B2

(12) United States Patent
Israelsson et al.

(10) Patent No.: US 11,085,635 B2
(45) Date of Patent: Aug. 10, 2021

(54) SYSTEM AND PROCESS FOR RECYCLING FLUIDIZED BOILER BED MATERIAL

(71) Applicant: Improbed AB, Malmo (SE)

(72) Inventors: Mikael Israelsson, Gothenburg (SE); Bengt-Ake Andersson, Molnlycke (SE); Lars Bierlein, Malmo (SE)

(73) Assignee: Improbed AB, Malmo (SE)

( * ) Notice: Subject to any disclaimer, the term of this patent is extended or adjusted under 35 U.S.C. 154(b) by 176 days.

(21) Appl. No.: 16/604,911

(22) PCT Filed: Apr. 10, 2018

(86) PCT No.: PCT/EP2018/000177
§ 371 (c)(1),
(2) Date: Oct. 11, 2019

(87) PCT Pub. No.: WO2018/188786
PCT Pub. Date: Oct. 18, 2018

(65) Prior Publication Data

US 2020/0292169 A1 Sep. 17, 2020

(30) Foreign Application Priority Data

Apr. 12, 2017 (EP) ..... 17166323

(51) Int. Cl.
*F23J 3/06* (2006.01)
*F23C 10/01* (2006.01)
*F23C 10/26* (2006.01)

(52) U.S. Cl.
CPC ..... *F23J 3/06* (2013.01); *F23C 10/01* (2013.01); *F23C 10/26* (2013.01);
(Continued)

(58) Field of Classification Search
CPC ... F23J 3/06; F23C 10/01; F23C 10/26; F23C 2206/102; F23C 2900/10001; F23C 2900/10004
See application file for complete search history.

(56) References Cited

U.S. PATENT DOCUMENTS 2,750,903 A * 6/1956 Miller ..... F23C 99/00 110/165 A
3,935,094 A * 1/1976 Bergeron ..... B03C 1/00 209/8

FOREIGN PATENT DOCUMENTS

CN 101210396 A 7/2008
CN 102575842 A 7/2012
(Continued)

OTHER PUBLICATIONS

International Search Report, Int'l Patent Application No. PCT/EP2018/000177, dated Aug. 31, 2018, 15 pages.
(Continued)

*Primary Examiner* — David J Laux
(74) *Attorney, Agent, or Firm* — Casimir Jones, S.C.; Brian F. Bradley

(57) ABSTRACT

The invention relates to a system for recycling fluidized bed boiler bed material, comprising: a. a bottom ash removal device for removing bed material from a fluidized bed boiler, b. a mechanical classifier (10) comprising a mesh size from 200 to 1,000 μm designed to separate a coarse and a fine particle size fraction, c. a magnetic separator (12) designed to magnetically classify the fine particle fraction from the mechanical classifier, d. a device for recirculating the magnetic particle fraction into the boiler. The invention allows effective recirculation and reuse of ilmenite bed material.

21 Claims, 2 Drawing Sheets

Figure 1:
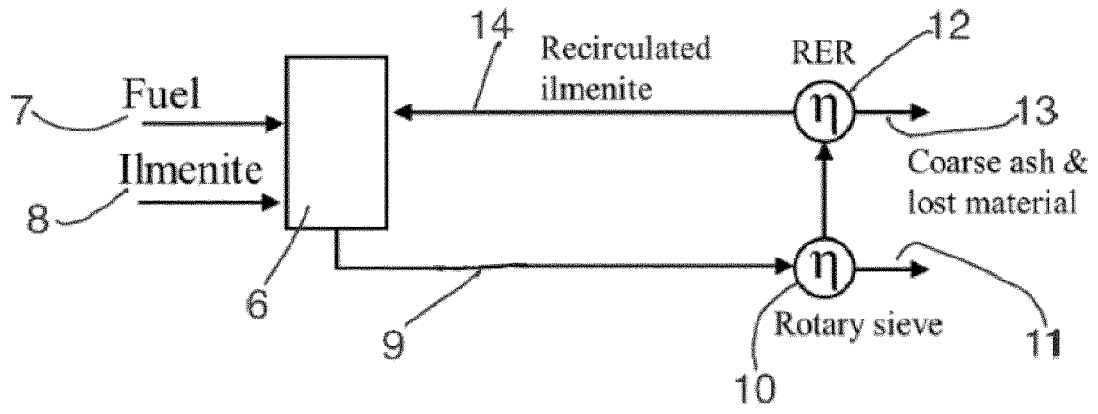

(52) U.S. Cl.
CPC ..... *F23C 2206/102* (2013.01); *F23C 2900/10001* (2013.01); *F23C 2900/10004* (2013.01)

(56) References Cited

FOREIGN PATENT DOCUMENTS

| | | | |
|---|---|---|---|
| DE | 103 41 610 | A1 | 5/2005 |
| EP | 3 106 531 | A1 | 12/2016 |
| EP | 3 153 776 | A1 | 4/2017 |
| JP | 2003 262320 | A | 9/2003 |

OTHER PUBLICATIONS

International Preliminary Report on Patentability, Int'l Patent Application No. PCT/EP2018/000177, dated Oct. 24, 2019, 8 pages.
Extended European Search Report, European patent application No. 17166323.0, dated Sep. 22, 2017, 6 pages.

* cited by examiner

SYSTEM AND PROCESS FOR RECYCLING FLUIDIZED BOILER BED MATERIAL

The invention relates to a process and system for recycling fluidized boiler bed material in the context of a bed management cycle for a fluidized bed boiler, such as a circulating fluidized bed boiler or a bubbling fluidized bed boiler and a corresponding arrangement for carrying out fluidized bed combustion.

Fluidized bed combustion is a well-known technique, wherein the fuel is suspended in a hot fluidized bed of solid particulate material, typically silica sand and/or fuel ash. Other bed materials are also possible. In this technique, a fluidizing gas is passed with a specific fluidization velocity through a solid particulate bed material. The bed material serves as a mass and heat carrier to promote rapid mass and heat transfer. At very low gas velocities the bed remains static. Once the velocity of the fluidization gas rises above the minimum fluidization velocity, at which the force of the fluidization gas balances the gravity force acting on the particles, the solid bed material behaves in many ways similarly to a fluid and the bed is said to be fluidized. In bubbling fluidized bed (BFB) boilers, the fluidization gas is passed through the bed material to form bubbles in the bed, facilitating the transport of the gas through the bed material and allowing for a better control of the combustion conditions (better temperature and mixing control) when compared with grate combustion. In circulating fluidized bed (CFB) boilers the fluidization gas is passed through the bed material at a fluidization velocity where the majority of the particles are carried away by the fluidization gas stream. The particles are then separated from the gas stream, e.g., by means of a cyclone, and recirculated back into the furnace, usually via a loop seal. Usually oxygen containing gas, typically air or a mixture of air and recirculated flue gas, is used as the fluidizing gas (so called primary oxygen containing gas or primary air) and passed from below the bed, or from a lower part of the bed, through the bed material, thereby acting as a source of oxygen required for combustion. A fraction of the bed material fed to the combustor escapes from the boiler with the various ash streams leaving the boiler, in particular with the bottom ash. Removal of bottom ash, i.e. ash in the bed bottom, is generally a continuous process, which is carried out to remove alkali metals (Na, K) and coarse inorganic particles/lumps from the bed and any agglomerates formed during boiler operation, and to keep the differential pressure over the bed sufficient. In a typical bed management cycle, bed material lost with the various ash streams is replenished with fresh bed material.

From the prior art it is known to replace a fraction or all of the silica sand bed material with ilmenite particles in the CFB process (H. Thunman et al., Fuel 113 (2013) 300-309). Ilmenite is a naturally occurring mineral which consists mainly of iron titanium oxide ($FeTiO_3$) and can be repeatedly oxidized and reduced. Due to the reducing/oxidizing feature of ilmenite, the material can be used as oxygen carrier in fluidized bed combustion. The combustion process can be carried out at lower air-to-fuel ratios with the bed comprising ilmenite particles as compared with non-active bed materials, e.g., 100 wt.-% of silica sand or fuel ash particles.

The problem underlying the invention is to provide an improved process and system as indicated above for ilmenite containing bed material.

The system according to the invention comprises the following elements:

a. a bottom ash removal device for removing bed material from a fluidized bed boiler,
b. a mechanical classifier comprising a mesh size from 200 to 1,000 μm designed to separate a coarse and a fine particle size fraction,
c. a magnetic separator designed to magnetically classify the fine particle fraction from the mechanical classifier,
d. a device for recirculating the magnetic particle fraction into the boiler.

First, several terms are explained in the context of the invention.

Fluidized bed boiler is a term well known in the art. The invention can be used in particular for bubbling fluidized bed (BFB) boilers, and circulating fluidized bed (CFB) boilers.

The bottom ash removal device is known in the art and removes boiler bottom ash together with bed material. The bottom ash removal device in the sense of the invention may be part of an existing system for bottom ash recirculation.

The purpose of the invention is to improve separation of reusable ilmenite bed material from the bottom ash so as to allow effective recirculation/recycling of removed ilmenite bed material back into the boiler.

The invention has recognized that ilmenite particles can be conveniently separated from the boiler ash and that even after extended use as bed material in a fluidized bed boiler ilmenite still shows very good oxygen-carrying properties and reactivity towards oxidizing carbon monoxide (CO) into carbon dioxide ($CO_2$), so called "gas conversion" and good mechanical strength. In particular, the invention has recognized that the attrition rate of the ilmenite particles surprisingly decreases after an extended residence time in the boiler and that the mechanical strength is still very good after the ilmenite has been utilized as bed material for an extended period of time. This was surprising, since ilmenite particles, after having experienced an initial activation phase, undergo chemical aging as they are subjected to repeated redox-conditions during combustion in fluidized bed boilers and the physical interactions with the boiler structures induce mechanical wear on the ilmenite particles. It was therefore expected that the oxygen-carrying capacity of ilmenite particles and their attrition resistance rapidly deteriorate during the combustion process in a fluidized bed boiler.

The invention has recognized that in light of the good attrition resistance the surprisingly good oxygen-carrying properties of used ilmenite particles can be exploited by recirculating the separated ilmenite particles into the boiler bed. This reduces the need to feed fresh ilmenite to the boiler which in turn significantly reduces the overall consumption of the natural resource ilmenite and makes the combustion process more environmentally friendly and more economical. In addition, the separation of ilmenite from the ash and recirculation into the boiler allows for the control of the ilmenite concentration in the bed and eases operation. Furthermore, the inventive bed management cycle further increases the fuel flexibility by allowing to decouple the feeding rate of fresh ilmenite from the ash removal rate, in particular the bottom ash removal rate. Thus changes in the amount of ash within the fuel become less prominent since a higher bottom bed regeneration rate can be applied without the loss of ilmenite from the system.

The invention combines a first mechanical classification using a mesh size from 200 to 1,000 μm and a subsequent magnetic separation of the fine particle size fraction to retrieve ilmenite to be recirculated into the boiler.

The invention has found out that the majority of ilmenite in the bottom ash comprises a particle size of 500 μm or lower so that the mechanical classifier provides a fine particle size fraction having a more homogenous size distribution while still comprising the majority of the ilmenite particles. The magnetic separation in the second step can be carried out more efficiently.

The initial mechanical classification in particular serves three purposes. First, it contributes to protect the magnetic separator from large ferromagnetic objects such as nails which could otherwise damage the magnetic separator or its parts. Second, it reduces the load on the magnetic separator by reducing the mass flow. Third, it enables simpler operation of the magnetic separator as it generates a narrower particle size distribution.

Preferably the mechanical classifier comprises a mesh size from 300 to 800 μm, preferably 400 to 600 μm. A typical preferred mesh size is 500 μm. This is sufficient to remove the bulk of the coarse bottom ash species.

In a particularly preferred embodiment the mechanical classifier comprises a rotary sieve which has been found effective to pre-classify the bottom ash to remove coarse particles.

In one embodiment of the invention the mechanical classifier further comprises a primary sieve prior to the mechanical classifier having the mesh size as defined above (e.g. the rotary sieve) to separate coarse particles having a particle size of 2 cm or greater, e.g. coarse particle agglomerates of golf ball size.

In another embodiment of the invention the system may comprise a primary classifier separating very fine particles and recirculating those fine particles into the boiler prior to the mechanical classifier of feature b. of the main claim and the magnetic separator. This primary classifier may comprise an air classifier to retrieve the very fine particle fraction.

The system may comprise a device for separating elongate ferromagnetic objects from the ash stream prior to the magnetic separator. The mechanical classifier can comprise a slot mesh to remove small pieces of thin metal wire or nails that tend to plug mesh holes and also affect the magnetic separation in the subsequent step.

Preferably the magnetic separator comprises a field intensity of 2,000 Gauss or more, preferably 4,500 Gauss or more on the surface of the transport means of the bed material. This has been found effective to separate ilmenite from ash and other nonmagnetic particles in the particle stream.

It is also an independent embodiment of the invention to utilize the magnetic separator having the field intensity or field strength as indicated above without prior mechanical classification or mechanical sieving. While mechanical classification prior to the magnetic separation is advantageous the invention in another embodiment is a system comprising such a magnetic separator only. Another embodiment of the invention is a process comprising the step of magnetic separation with the indicated field intensity without prior mechanical classification or sieving.

Preferably the magnetic separator comprises a rare earth roll (RER) or rare earth drum (RED) magnet. Corresponding magnetic separators are known in the art per se and are e.g. available from Eriez Manufacturing Co. (www.eriez.com). Rare earth roll magnetic separators are high intensity, high gradient, permanent magnetic separators for the separation of magnetic and weakly magnetic iron particles from dry products. The bottom ash stream is transported on a belt which runs around a roll or drum comprising rare earth permanent magnets. While being transported around the roll ilmenite remains attracted to the belt whereas the nonmagnetic particle fracture falls off. Mechanical separator separates these two particle fractions.

In one embodiment of the invention the magnetic field is axial, i.e. parallel to the rotational axis of the drum or roll. An axial magnetic field with the magnets having a fixed direction causes strongly magnetic material to tumble as it passes from north to south poles, releasing any entrapped nonmagnetic or paramagnetic materials.

In another embodiment of the invention the magnetic field is radial, i.e. comprising radial orientation relative to the rotational axis. Generally a radial orientation has the advantage of providing a higher recovery rate of all weakly magnetic material which can come at the cost of less purity due to entrapped nonmagnetic material.

It is also possible to use a two stage magnetic separation with a first step using axial orientation thereby helping to release entrapped nonmagnetic material and the second step using radial orientation to increase the recovery rate.

Preferably the separation efficiency of the system for ilmenite bed material is at least 0.5 by mass, preferably at least 0.7 by mass. That means that at least 50 or 70 wt. % of ilmenite comprised in the bottom ash stream can be separated from the bottom ash and recirculated into the boiler.

The recirculation capacity and separation efficiency is also affected by the ash flow temperature where there is a tradeoff between the separation efficiency and the ash flow temperature. A higher temperature will decrease the efficiency of the magnetic separation and leads to the use of more expensive heat resistant materials in the system. By adopting measures for cooling the ash flow the negative effects on the separation efficiency and material requirements of high temperatures can be negated. The system can also be equipped with temperature sensors and ash flow splitters that will allow the flow to be redirected and bypassing the separation system in case of temporary high temperatures.

In a second aspect the invention relates to a process for recycling fluidized bed boiler bed material comprising ilmenite, the process comprising the steps of:

a. removing bed material from a fluidized bed boiler,
b. mechanically classifying the bed material using a mesh size from 200 to 1,000 μm to separate a coarse and a fine particle size fraction,
c. magnetically classifying the fine particle fraction from the mechanical classifier,
d. recirculating the magnetic particle fraction into the boiler.

Subsequent to step a. and prior to step b. may be a step of recirculating part of the removed bed material into the boiler prior to mechanical classification and magnetic separation. For example a very fine particle fraction from the removed bed material may be air classified and immediately returned to the boiler.

Preferably the separation efficiency of step c. is at least 0.5 by mass, preferably at least 0.7 by mass for ilmenite as explained above in the context of the system.

According to one aspect of the invention, the average residence time of ilmenite in the boiler is 20 h or more, preferably 30 h or more, preferably 40 h or more, preferably 100 h or more, preferably 200 h or more, further preferred 300 h or more.

The invention has recognized that the surprisingly good oxygen-carrying capacity and attrition resistance of ilmenite particles that have been exposed to boiler conditions for an extended period of time allow for average residence times of the ilmenite particles in the boiler which are at least a factor of 2.5 higher than typical residence times of bed material in conventional fluidized bed boilers. The invention has found that even after extended operation in a fluidized bed boiler, ilmenite particles still show very good oxygen-carrying properties, gas conversion and mechanical strength.

In the context of the invention, the average residence time of the ilmenite particles in the boiler ($<T_{Res,ilmenite}>$) is defined as the ratio of the total mass of ilmenite in the bed inventory ($M_{ilmenite}$) to the product of the feeding rate of fresh ilmenite ($R_{feed,ilmenite}$) with the production rate of the boiler ($R_{Production}$):

$$T_{Res,ilmenite}=M_{ilmenite}/(R_{feed,ilmenite}\times R_{Production})$$

By way of example, if the total mass of ilmenite in the boiler is 25 tons, the feeding rate of fresh ilmenite is 3 kg/MWh and the production rate is 75 MW, this gives the average residence time $T_{Res,ilmenite}=25/(3\times75/1000)$ h=111 h. Recirculation of separated ilmenite particles is a convenient way of extending the average residence time of the ilmenite particles in the boiler since the feeding rate for fresh ilmenite can be reduced.

In the operation of the boiler, the fraction of ilmenite in the bed material can be kept at 25 wt. % or more, preferably 30 wt. % or more. In another embodiment of the invention, preferred ilmenite concentrations in the bed are between 10 wt. % and 95 wt %, more preferably between 50 wt.-% and 95 wt. %, more preferably between 75 wt.-% and 95 wt.-%.

Embodiments of the invention are now shown by way of example with reference to the figures.

Figure 2:
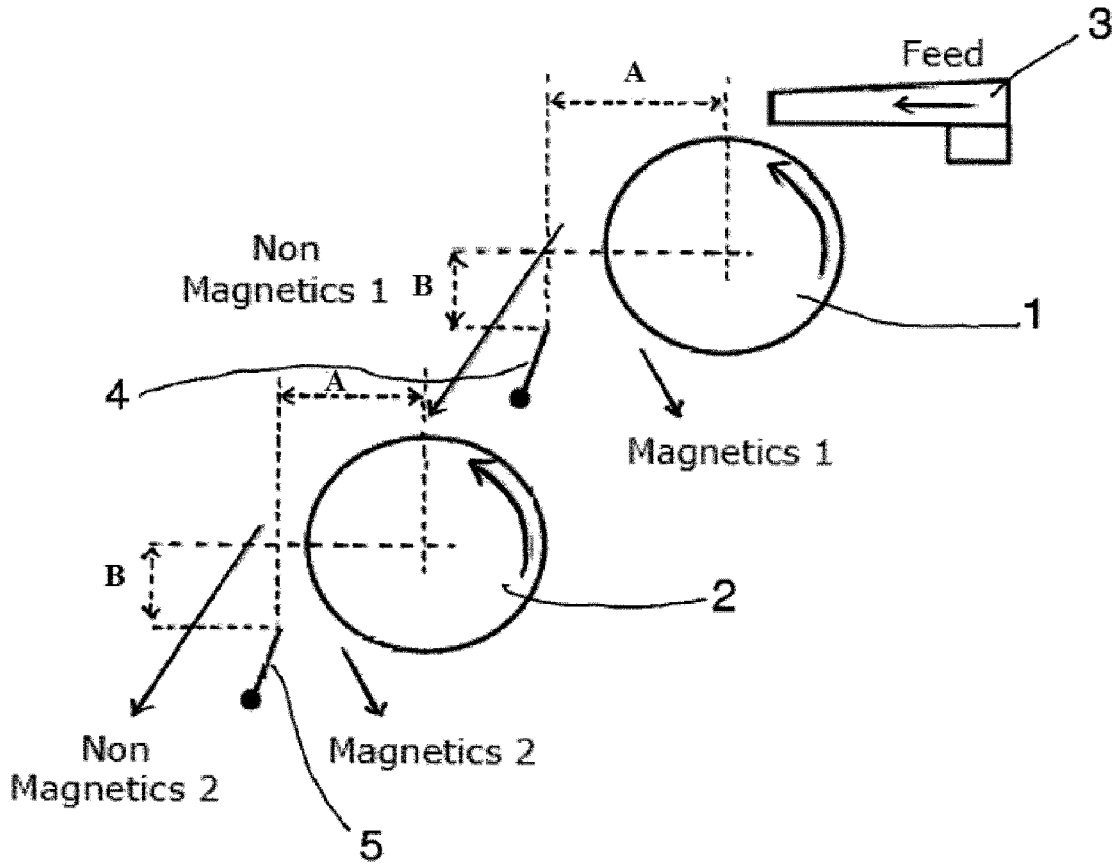
Figure 3:
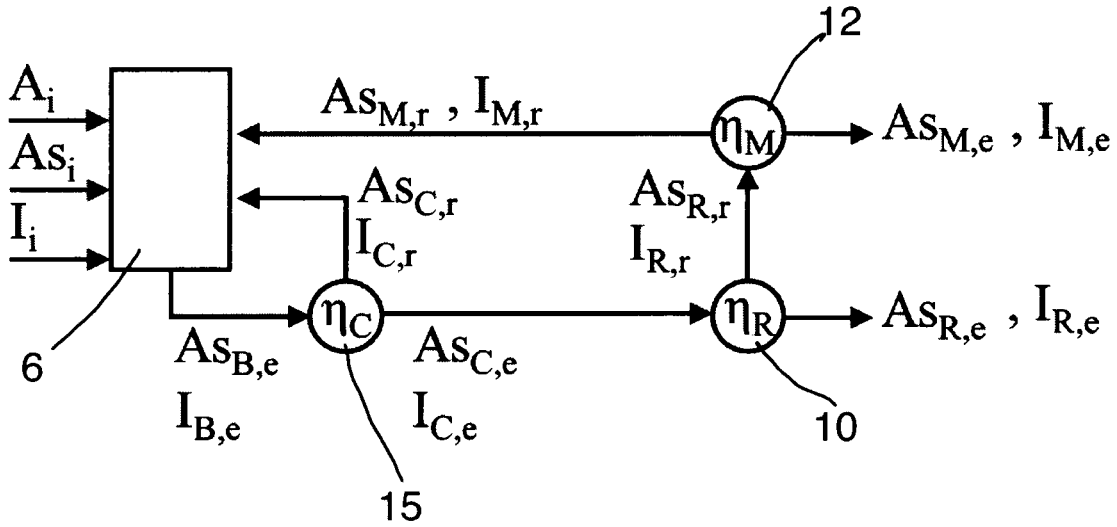

It is shown in:

FIG. 1: a schematic illustration of a system according to the invention in cooperation with a boiler, FIG. 2: a schematic illustration of magnetic drum separator, FIG. 3: a schematic illustration to show the mass streams in an embodiment of the process according to the invention.

EXAMPLE 1

In this example the composition and particle size distribution of bottom ash is analyzed. The bottom ash was taken from a 75 MW municipal solid waste fired boiler operating with the bed material comprising silica sand and 16 wt. % ilmenite.

The bottom ash was sieved through a 500 μm mesh which removed the particle fraction coarser than 500 μm (about 50 wt. % of the original sample).

The bottom ash sample, excluding particulates coarser than 500 μm, of 8.3 kg was analyzed for ranges of material content of bed materials (ilmenite, silica oxide, calcium oxide, aluminum oxide) and particle size distribution.

Material composition (ranges, wt. %):

| | |
|---|---|
| Ilmenite: | 10-20% |
| Silica oxide: | 40-60% |
| Calcium oxide: | 5-10% |
| Aluminum oxide: | 5-10% |

Particle size distribution (wt. %):

| | |
|---|---|
| 355-500 μm: | ~7% |
| 250-355 μm | ~17% |
| 125-250 μm: | ~69% |
| <125 μm: | ~7% |

This analysis shows typical percentages of ilmenite in the bottom ash which can be retrieved according to the invention and also shows that the particle size distribution of the bottom ash does allow an initial mechanical classification to remove coarse particles with e.g. a mesh size of 500 μm.

EXAMPLE 2

In this example the effectiveness of magnetic separation processes is tested. The following test equipment was used:

Eriez® 305 mm dia.×305 mm wide model FA (Ferrite Axial) magnetic drum. Field strength ca. 2000 Gauss (drum #1).

Eriez® 305 mm dia.×305 mm wide model RA (Rare Earth Axial) magnetic drum. Field strength ca. 4500 Gauss (drum #2).

Eriez® 305 mm dia.×305 mm wide model RR (Rare Earth Radial) magnetic drum. Field strength ca. 4000 Gauss (drum #3).

FIG. 2 shows an arrangement of two magnetic separation drums or rolls in sequential order.

Material is fed through a feed 3 on a magnetic drum 1 rotating into the direction indicated by the arrow (counter-clockwise). Magnetic particles tend to adhere to the drum longer than nonmagnetic particles which is indicated by the arrows nonmagnetics 1 and magnetics 1 in the drawing. A mechanical separator blade 4 helps to separate the magnetic and nonmagnetic particle fractions.

When using a two-stage process, the nonmagnetic particle fraction from the first drum 1 can be fed to a second drum 2 for a second magnetic separation step.

Three tests were carried out, the first test using a two-step separation process and the second and third test using single step separation processes. The tests were carried out with bottom ash as analyzed in example 1.

Test 1

A 2.5 kg bottom ash sample was passed over a ferrite magnetic drum (drum #1) with an axial magnet arrangement. This causes the strongly magnetic material to tumble as it passes from north to south poles, releasing any entrapped nonmagnetic or paramagnetic materials, thus providing a cleaner magnetic fraction.

The nonmagnetic fraction from this first separation step was then passed over a second drum (drum #2), with a stronger Rare Earth axial magnetic field.

Test 2

A 1.25 kg bottom ash sample was passed over a drum (drum #2), with a strong Rare Earth axial magnetic field.

Test 3

A 1.25 kg bottom ash sample was passed over a drum (drum #3), with a strong Rare Earth radial magnetic field.

Both tests 2 and 3 utilized single step magnetic separation.

The test results are shown in the following table. The table also indicates the splitter position in terms of the distances A and B of the leading edge of the mechanical splitter from the rotational axis of the drum (see FIG. 2) and the drum speed in terms of $min^{-1}$ and surface speed in m/min. The table also indicates the results of the magnetic separation.

| Test No. | Drum Type | Feed Rate (t/hr) | Splitter Position A | Splitter Position B | Drum Speed RPM | Drum Speed M/Min. | Description | Sample No. | Weight (g) | % of Feed Weight |
|---|---|---|---|---|---|---|---|---|---|---|
| 1 | FA | 1.5 | 125 mm | 140 mm | ~63 | 60 | Feed | 100 | 2498 | |
| | | | | | | | Magnetics 1 | 101 | 716 | 28.7 |
| | | | | | | | Non Magnetics 1 | 102 | 1782 | 71.3 |
| | RA | 1.5 | 70 mm | 160 mm | ~63 | 60 | Magnetics 2 | 103 | 236 | 16.8 |
| | | | | | | | Non Magnetics 2 | 104 | 764 | 54.5 |
| 2 | RA | 1.5 | 70 mm | 160 mm | ~63 | 60 | Feed | | 1248 | |
| | | | | | | | Magnetics 1 | 201 | 593 | 47.5 |
| | | | | | | | Non Magnetics 1 | 202 | 655 | 52.5 |
| 3 | RR | 1.5 | 115 mm | 170 mm | ~63 | 60 | Feed | | 1247 | |
| | | | | | | | Magnetics 1 | 301 | 736 | 59.0 |
| | | | | | | | Non Magnetics 1 | 302 | 511 | 41.0 |

EXAMPLE 3

FIG. 1 shows schematically an embodiment of the system of the invention connected to a boiler.

A boiler 6 is fed with fuel (waste) at 7 and ilmenite bed material at 8.

Bottom ash is retrieved via 9 and fed to a rotary sieve 10 having a mesh size of 500 μm. The coarse fraction comprising mostly ash and some lost ilmenite material is discarded at 11.

The fine particle size fraction is fed to a magnetic separator 12 comprising a rare earth roll magnet (as shown above). The nonmagnetic fraction from the magnetic separator 12 is discarded at 13. The magnetic fraction is recirculated as bed material (ilmenite) to the boiler at 14.

EXAMPLE 4

This example serves to illustrate material stream calculations in a further embodiment of the invention shown in FIG. 3.

The system of FIG. 3 corresponds to that of FIG. 1 but additionally comprises a classifier 15 wherein the finer particles from the bottom ash are entrained by an airflow and carried back to the boiler.

A bottom ash mass balance, taking into account coarse ash, fine ash, and ilmenite was constructed for the system shown in FIG. 3.

Coarse ash components (A) include large particles that are easily separated by the existing recirculation system and are not accumulated, fine ash components (As) include inert sand and small agglomerates of ash that can be accumulated by the existing recirculation system, the ilmenite (I) can also, of course, be accumulated by the existing recirculation system.

For the purposes of this example, the boiler is a 75 MW municipal solid waste fired boiler with a classifier that operates at 95% separation efficiency for ilmenite and fine ash. The material streams of interest are denoted in FIG. 3. Another material stream, not included in the model, consists of the very fine particles that are carried out of the furnace by the flue gas and separated as fly ash in the flue gas treatment plant, e.g. a bag-house filter or an electrostatic precipitator. This material stream consists of very fine particles from the fuel, very fine particles of fresh bed material and very fine bed material particles formed by attrition in the furnace.

C denotes the classifier 15, B the boiler 6, R the rotary sieve 10, and M the magnetic separator 12. The indexes e and r denotes exiting and returning respectively. The separation efficiencies of the classifier and rotary sieve are assumed to be equal for ilmenite and fine ash while the magnetic separator is described using two different efficiencies for ilmenite and fine ash (optimally 0% for ash). The separation efficiency is varying in relation to the inflow for all separators of the system: classifier, mechanical and magnet.

The mass balances for ilmenite and fine ash are similar and therefore only that of ilmenite is described as follows, $m_i$ denotes the mass of ilmenite inside the boiler.

$$I_i = 225\ \frac{\text{kg}}{\text{h}} \quad As_i = 1000\ \frac{\text{kg}}{\text{h}} \quad A_i = 4000\ \frac{\text{kg}}{\text{h}} \quad \eta_c = 0.95$$

$$\eta_T = 0 - 0.9 \quad \eta_{M,I} = 0 - 0.9 \quad \eta_{M,As} = 0 - 0.1 \quad m_{tot} = 25\ \text{ton}$$

$$\frac{dm_i}{dt} = I_i + I_{C,r} + I_{M,r} - I_{B,e} \tag{1}$$

$$I_{B,e} = (A_i + I_i + As_i + I_{C,r} + I_{M,r} + As_{C,r} + As_{M,r}) * \frac{m_i}{m_{tot}} \tag{2}$$

$$I_{C,r} = I_{B,e} * \eta_C \tag{3}$$

$$I_{C,e} = I_{B,e} - I_{C,r} \tag{4}$$

$$I_{R,r} = I_{C,e} * \eta_R \tag{5}$$

$$I_{R,e} = I_{C,e} - I_{R,r} \tag{6}$$

$$I_{M,r} = I_{R,r} * \eta_{M,I} \tag{7}$$

$$I_{M,e} = I_{R,r} - I_{M,r} \tag{8}$$

Upon deriving a matching set of equations for the fine ash (As), the system is calculated to yield the fraction of ilmenite in the boiler and the average time that the ilmenite spends inside the system.

For the base case (comparative example not according to the invention), the efficiencies of the rotary sieve and magnet are set to 0% while the case describing the system according to the invention uses efficiencies of 0.8, 0.8, and 0 for the rotary sieve, magnet on ilmenite and magnet on fine ash respectively.

The calculated data describe the fraction of ilmenite in the boiler, the average residence time of ilmenite within the system (including the effects of recirculation), and the possible reduction in the amount of introduced ilmenite that maintains the ilmenite fraction of the base case. The deduced data is presented in Table 2.

TABLE 2

| Case | Fraction of ilmenite in the bed [%] | Average residence time of ilmenite in the system [h] | Possible reduction in ilmenite feed [kg/h] (new flow) |
|---|---|---|---|
| derived data for the base case and for operation with the proposed system. | | | |
| Base case | 15.8 | 17.5 | — |
| Inventive system | 34.2 | 38.0 | 140 (85) |

The invention claimed is:

1. A system for recycling fluidized bed boiler bed material, comprising:

a) a bottom ash removal device for removing bed material from a fluidized bed boiler, b) a mechanical classifier (10) comprising a mesh size from 200 to 1,000 μm designed to separate a coarse and a fine particle size fraction, c) a magnetic separator (12) designed to magnetically classify the fine particle fraction from the mechanical classifier, d) a device for recirculating the magnetic particle fraction into the boiler.

2. The system of claim 1, wherein the mechanical classifier (10) comprises a mesh size from 300 to 800 μm.

3. The system of claim 2, wherein the mechanical classifier (10) comprises a mesh size from 400 to 600 μm.

4. The system of claim 1, wherein the mechanical classifier (10) comprises a rotary sieve.

5. The system of claim 4, wherein the mechanical classifier further comprises a primary sieve prior to the rotary sieve (10) to separate coarse particles having a particle size of 2 cm or greater.

6. The system of claim 1, further comprising a device for separating elongate ferromagnetic objects from the ash stream prior to the magnetic separator (12).

7. The system of claim 6, wherein the device for separating elongate ferromagnetic objects from the bed material prior to the magnetic separator (12) comprises a slot mesh.

8. The system of claim 1, wherein the magnetic separator (12) comprises a field intensity of 2,000 Gauss or more on the surface of the transport means of the bed material.

9. The system of claim 8, wherein the magnetic separator (12) comprises a field intensity of 4,500 Gauss or more on the surface of the transport means of the bed material.

10. The system of claim 1, wherein the magnetic separator (12) comprises a rare earth roll (RER) or rare earth drum (RED) magnet.

11. The system of claim 10, wherein the magnetic field is axial.

12. The system of claim 10, wherein the magnetic field is radial.

13. The system of claim 1, wherein the separation efficiency for ilmenite bed material is at least 0.5.

14. A process for recycling fluidized bed boiler bed material comprising ilmenite, the process comprising the steps of:

a) removing bed material from a fluidized bed boiler, b) mechanically classifying the bed material using a mesh size from 200 to 1,000 μm to separate a coarse and a fine particle size fraction, c) magnetically classifying the fine particle fraction from the mechanical classifier, d) recirculating the magnetic particle fraction into the boiler.

15. The process of claim 14, wherein the separation efficiency of step c) is at least 0.7 by mass for ilmenite.

16. The process of claim 14, wherein the average residence time of ilmenite in the system is 20 h or more.

17. The process of claim 14, wherein the average residence time of ilmenite in the system is 30 h or more.

18. The process of claim 14, wherein the average residence time of ilmenite in the system is 40 h or more.

19. The process of claim 14, wherein the average residence time of ilmenite in the system is 100 h or more.

20. The process of claim 14, wherein the fraction of ilmenite in the bed material is 25 wt. % or more.

21. The process of claim 14, wherein the fraction of ilmenite in the bed material is 30 wt. % or more.

* * * * *